US006419470B2

(12) United States Patent
Fujii et al.

(10) Patent No.: US 6,419,470 B2
(45) Date of Patent: Jul. 16, 2002

(54) SCROLL COMPRESSOR

(75) Inventors: Toshiro Fujii; Kazuo Murakami; Yoshiyuki Nakane; Susumu Tarao, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/737,539

(22) Filed: Dec. 15, 2000

(30) Foreign Application Priority Data

Dec. 15, 1999 (JP) ..... 11-356531

(51) Int. Cl.[7] ..... F03C 2/00
(52) U.S. Cl. ..... 418/55.2; 418/1
(58) Field of Search ..... 418/55.2, 1

(56) References Cited

U.S. PATENT DOCUMENTS 4,300,875 A * 11/1981 Fischer et al. ..... 418/55.2
4,432,708 A * 2/1984 Hiraga et al. ..... 418/55.1
4,435,136 A * 3/1984 Terauchi et al. ..... 418/55.1
4,781,550 A * 11/1988 Morishita et al. ..... 418/55.2
5,597,296 A * 1/1997 Akazawa et al. ..... 418/55.2
5,791,885 A * 8/1998 Fukuhara et al. ..... 418/55.2
6,129,532 A * 10/2000 Kato et al. ..... 418/55.2

FOREIGN PATENT DOCUMENTS

JP 55-46046 3/1980
JP 58-67902 4/1983
JP 5-312156 11/1993
JP 06-081781 * 3/1994 ..... 418/55.5
JP 11-094379 * 4/1999

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

Scroll compressors are taught that include an outer peripheral portion (23) of a movable scroll member (20) disposed opposite of an end face (13) of a stationary scroll member (10). At least one end portion (20, 23) has a shape that prevents contact when the movable scroll member (20) bends or deforms under high pressure. The contact avoiding shape or structure may be, for example, a tapered portion, a recessed portion or a step shaped portion.

19 Claims, 4 Drawing Sheets

SCROLL COMPRESSOR

BACKGROUND OF THE INVENTION

1. Field of the Invention

The present teachings relate to scroll compressors for compressing fluids, such as a refrigerant, and such scroll compressors may be utilized, for example, in air conditioning systems and refrigerating systems.

2. Description of the Related Art

Japanese Laid-Open Patent Publication No. 5-312156 discloses a known scroll compressor. As shown in FIG. 6, the known scroll compressor includes a stationary scroll member 110 and a movable scroll member 120. The movable scroll member 120 moves in an orbital motion about the stationary scroll member 110. The stationary scroll member 110 has a volute wall 112 extending from a base plate 111, and the movable scroll member 120 has a volute wall 122 extending from a base plate 121. The scroll members 110, 120 are arranged in such a manner that the respective volute walls 112, 122 are proximally disposed with respect to each other and co-operate to compress a fluid. A plurality of compression chambers 114 are defined between the stationary scroll member 110 and the movable scroll member 120. As the movable scroll member 120 orbits with respect to the stationary scroll member 110, fluid is drawn into the compression chamber 114 and compressed as the compression chambers 114 shift toward the center of the scroll members 110 and 120, thereby reducing the space within the compression chambers 114.

In the known scroll compressor, a high pressure is generated in the compression chambers 114 as the fluid is compressed. The high pressure is exerted against the stationary scroll member 110 and the movable scroll member 120. The pressure in the compression chamber 114 becomes higher as the compression chamber 114 shifts from the outer periphery toward the center of the scroll members. As a result, as shown in exaggerated form in FIG. 6, the movable scroll member 120 will deform so that its central section bulges towards to the right, as shown in FIG. 6. Because the end face of the outer peripheral portion 113 of the movable scroll member 120 and the end face 123 of the stationary scroll member 110 will come into contact due to the deformation of the movable scroll member 120, friction will be generated between the movable scroll member 120 and the stationary scroll member 110. Therefore, power loss and seizing may be caused by this friction.

SUMMARY OF THE INVENTION

It is accordingly an object of the present teachings is to provide an improved scroll compressor.

Because the movable scroll member of the known scroll compressor will deform as the pressure of the fluid in the compression chamber is increased, the known scroll compressor is prone to power loss and seizing when the compression chamber is under high pressure. Consequently, such problems are preferably overcome by the present teachings.

In one aspect of the present teachings, a scroll compressor may include a stationary scroll member, a movable scroll member and a plurality of compression chambers defined between the two scroll members. As the pressure in the compression chambers increases, the movable scroll member will deform. Therefore, end portions of the base plates of the scroll members are arranged and constructed to avoid contact when the movable scroll member deforms. Thus, by designing the end portions according to the present teachings, power loss and seizures can be avoided, thereby improving compression efficiency.

The end portions preferably comprise a contact avoiding structure, in which at least one of the end portions of the base plates of the scroll members has a shape that will avoid contact with the end portion of the other scroll member when the movable scroll member deforms. Although the contact avoiding structure may be relatively simple, it is effective to prevent contact between the end portion of the stationary scroll member and the end portion of the movable scroll member during operation under high pressure.

Such scroll compressors may preferably compress carbon dioxide ($CO_2$) as a refrigerant. The pressure difference of $CO_2$ between its lower pressure and higher pressure may be, for example, more than 5 MPa (megapascal). That is, when the carbon dioxide is compressed, the compression chamber 114 will be subjected to a higher pressure than usual, and the movable scroll member 120 is likely to deform. However, even if the movable scroll member deforms, scroll compressors according to the present teachings can effectively prevent the movable scroll member 120 from contacting the stationary scroll member 110.

For example, the scroll compressors may preferably be utilized in air conditioning systems and in refrigerating systems. More preferably, the scroll compressors may be utilized in automobile air conditioning systems.

DETAILED DESCRIPTION OF THE INVENTION

Figure 1:
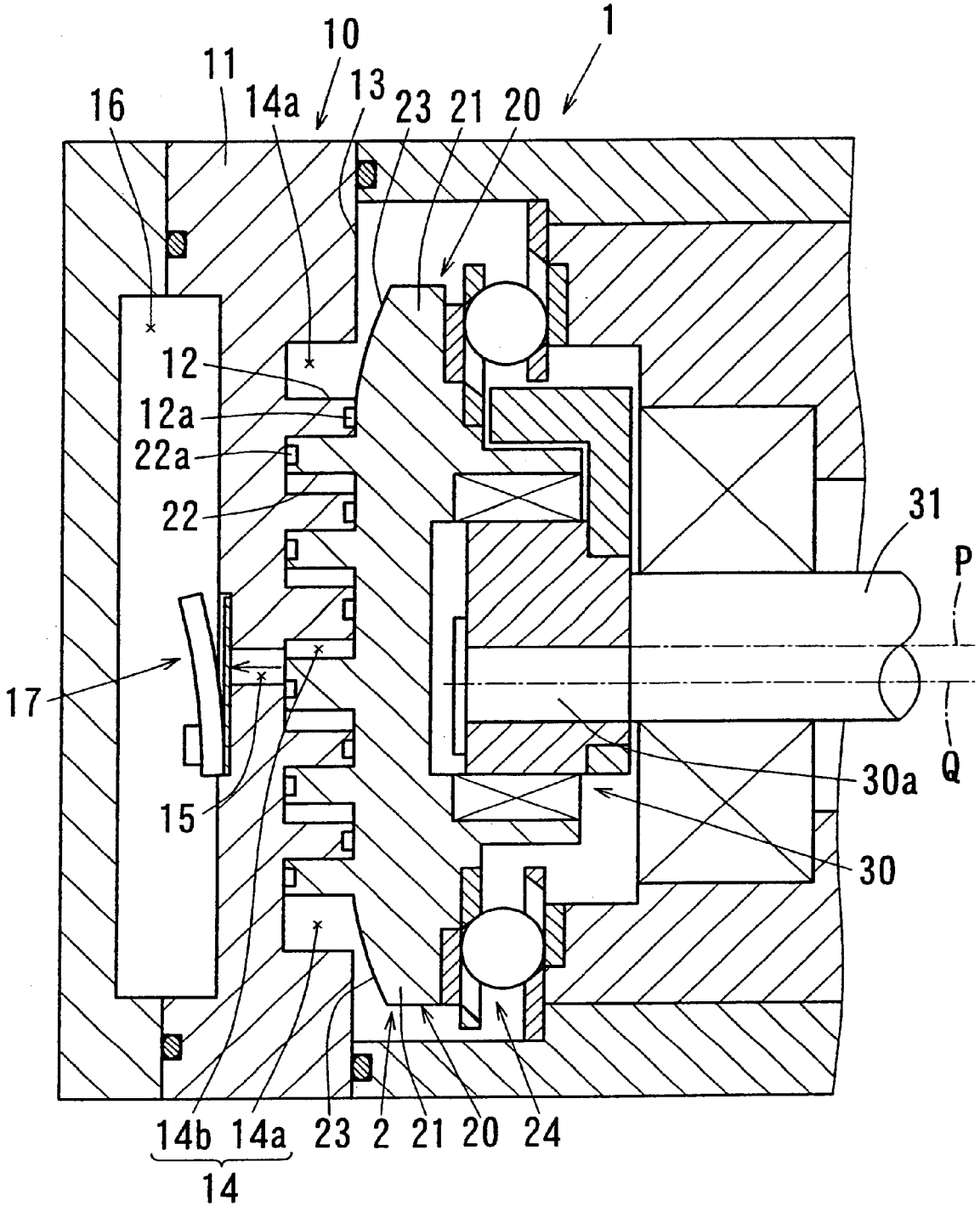
FIG. 1 schematically shows the internal cross section of a scroll compressor according to a first representative embodiment of the present teachings.

Scroll compressors are taught that may include a stationary scroll member comprising a base plate having an end surface. A movable scroll member comprising a base plate having an outer peripheral portion may be disposed in an opposing relationship to the stationary scroll member. A plurality of compression chambers may be defined between the stationary scroll member and the movable scroll member. The compression chambers are formed to compress a fluid, such as a gas. Preferably, either one or both end faces of the stationary scroll member and/or the outer peripheral portion of moveable scroll member have a contact avoiding structure. In known scroll compressors, when the movable scroll member deforms under high pressure, which is caused by the compression of the fluid, the periphery of the movable scroll member and the end face of the stationary scroll member will contact each other. However, according to the present teachings, the end face of the stationary scroll member will not contact the periphery of the movable scroll member when the compression chamber is under high pressure. That is, the end face of the stationary scroll member and the periphery of the moveable scroll member are preferably constructed and arranged to avoid contact when the moveable scroll member deforms in response to a high pressure condition in the compression chamber.

For example, the contact avoiding structure may be a tapered shape formed in the end face of the stationary scroll member and the tapered shape may be inclined toward the outer peripheral direction. Alternatively, the contact avoiding structure may be a recess shape formed in the periphery of the movable scroll member. Further, the contact avoiding structure may be a step shape formed in the end face of the stationary scroll member. Naturally, various other structures for avoiding contact between the periphery of the movable scroll member and the end face of the stationary scroll member may be utilized according to the present teachings.

Preferably, such a scroll compressor may be utilized to compress carbon dioxide and may be utilized, for example, in an automobile air conditioning system.

Methods for compressing a fluid in such scroll compressors may include drawing a fluid into the compression chamber, compressing the fluid and discharging a highly pressurized fluid. Preferably, the end portions of the scroll members do not contact when the fluid is pressurized and the movable scroll member deforms under pressure.

Further representative examples of the present teachings will now be described in further detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and aspects disclosed in the following detail description may not be necessary to practice the invention in the broadest sense, and are instead taught merely to particularly describe some representative examples of the invention. Moreover, various features of the representative examples may be combined in ways that are not specifically enumerated in order to provide additional useful embodiments of the present teachings.

First Representative Embodiment

A scroll compressor according to a first embodiment of the present teachings will be described with reference to FIGS. 1–3. This scroll compressor may be used as a refrigerating compressor in an air conditioner or a refrigerating machine, and preferably compresses a refrigerant gas before discharging the compressed refrigerant gas. For example, the scroll compressor may be used in an air conditioner for vehicles.

As shown in FIG. 1, the scroll compressor 1 may include a scroll mechanism section 2 disposed within a hermetically enclosed casing, and a drive mechanism section (not shown) for driving the scroll mechanism section 2. The scroll mechanism section 2 may include a stationary scroll member 10, a movable scroll member 20, a supporting member 24 for orbitably supporting the movable scroll member 20, and other structures known in the art. The stationary scroll member 10 may have a spiral-shaped stationary volute wall 12 (i.e. an involute shape) extending from one surface of a stationary base plate 11 in the form of circular plate. The movable scroll The moveable scroll member 20 may also have a spiral-shaped movable volute wall 22 (i.e. an involute shape) extending from one surface of a moveable base plate 21 in the form of circular plate. The volute walls 12, 22 of the respective scroll members are engaged with each other. At the ends of the volute walls 12, 22, respective chip seals 12*a*, 22*a* are provided, which chip seals 12*a*, 22*a* preferably seal the volute walls 12, 22 during operation.

The movable scroll member 20 may be supported by the supporting member 24, and may be coupled to a drive shaft 31 of the drive mechanism section through a crank mechanism 30. A crankshaft 30*a* of the crank mechanism 30 is provided at position Q, which is eccentric from an axis P of the drive shaft 31. Due to the eccentricity of the crank shaft 30*a*, the movable volute wall 22 of the movable scroll member 20 is brought into contact with the stationary volute wall 12 of the stationary scroll member 10 at a plurality of portions of the respective wall surfaces at an inner peripheral side and outer peripheral side. In the compression chamber 14 defined by the volute walls 12, 22, a refrigerant, for example, carbon dioxide ($CO_2$) may be compressed. The drive shaft 31 can rotate about the axis P, and is preferably coupled to a rotation driving source (not shown).

The refrigerant in a low pressure section 14*a* of the compression chamber 14 is drawn in the direction toward the center of the movable scroll member 20 while the refrigerant is increasingly compressed in conjunction with the orbital movement of the movable scroll member 20, so as to form a high pressure section 14*b*. In the high pressure section 14*b*, the refrigerant is highly pressurized. The highly pressurized gas is then allowed to flow into a discharge chamber 16 via a discharge port 15 and a discharge valve mechanism 17 (i.e. a check valve). The discharge port 15 and discharge valve mechanism 17 open at a pre-determined pressure and are disposed in the central area of the base plate 11 of the stationary scroll member 10. The compressed gas then is discharged to the outside of the compressor (e.g., a refrigerating circuit).

Figure 2:
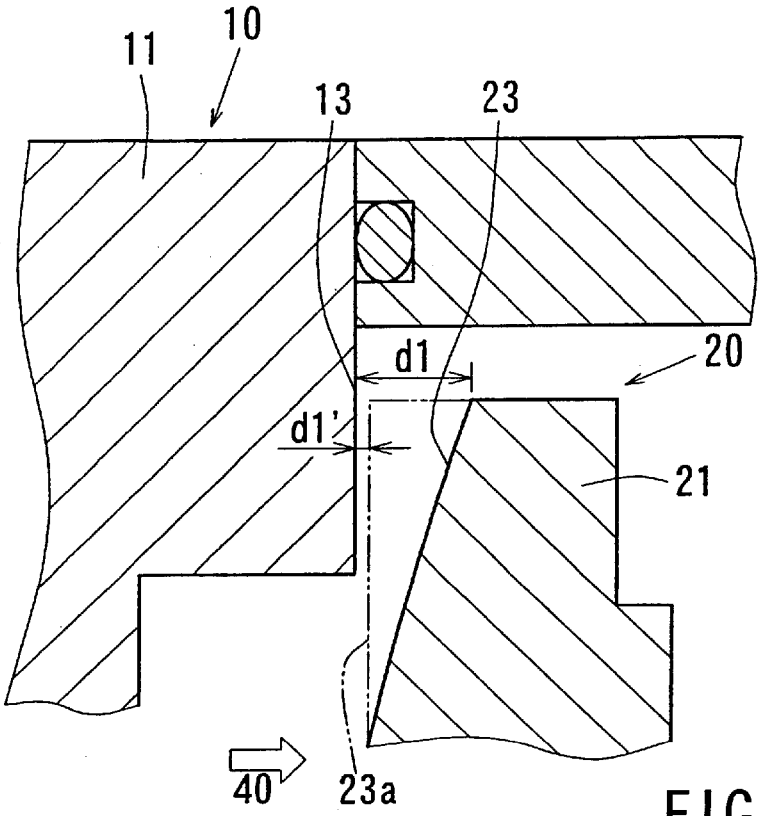
FIG. 2 is a partially enlarged view showing a periphery of an end portion of the movable scroll member of FIG. 1, and illustrating the relative positions between the stationary scroll member and the movable scroll member.
Figure 3:
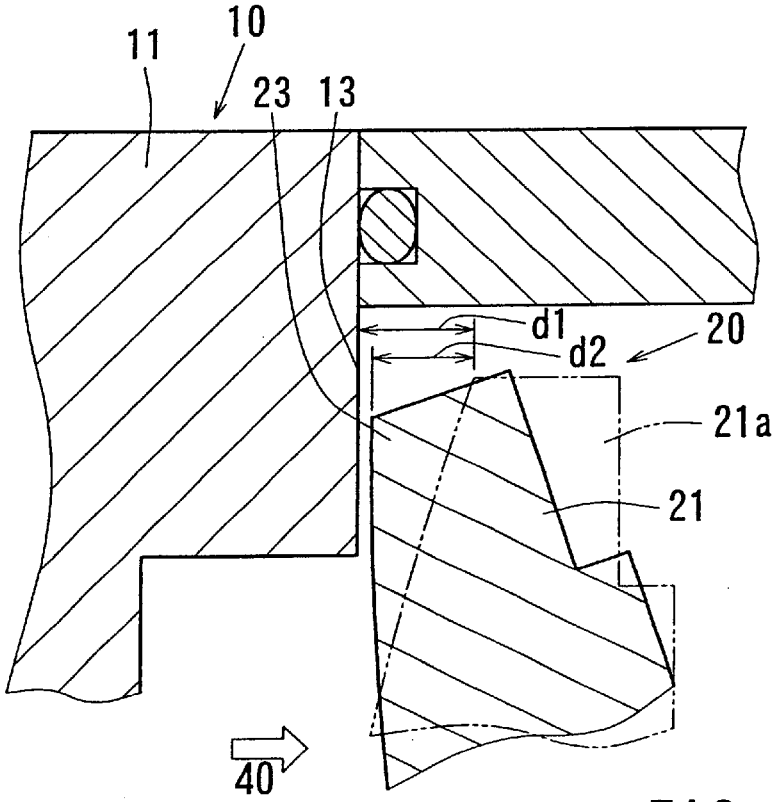
FIG. 3 is a partially enlarged view showing a periphery of an end portion of the movable scroll member of FIG. 1, and illustrating the relative positions between the stationary scroll member and the movable scroll member.

As shown in exaggerated form in FIG. 2, an outer peripheral portion 23 of the base plate 21 of the movable scroll member 20 is disposed in an opposing relationship with respect to an end face 13 of the base plate 11 of the stationary scroll member 10. Preferably, the opposing face of the peripheral portion 23 has a tapered or chambered shape that is inclined toward an outer peripheral direction at the whole circumference. The distance d1 between the opposing face of the outer peripheral portion 23 of the movable scroll member 20 and the end face 13 of the stationary scroll member 10 is preferably larger than the distance d1' between an end face of a known movable scroll member (shown by an alternating long and two short dashed line 23*a*,) and the end face 13 of a stationary scroll member 10. The structure of the outer peripheral portion 23 of the movable scroll member 20 corresponds to a representative contact avoiding structure of the present teachings.

A representative method for compressing a refrigerant using the scroll compressor 1 will be described with reference to FIGS. 1 to 3. When the drive shaft 31 is rotated by the driving source, the crankshaft 30*a* rotates about the axle center P, and the movable scroll member 20 orbits around the stationary scroll 10. The refrigerant is drawn into the compression chamber 14 located at the outer periphery, and is compressed as the contacting portions of the volute walls 12, 22, shift toward the central direction and the space of the compressor chamber 14 is reduced, due to the orbital movement of the movable scroll member 20. As the space of the compression chamber 14 is reduced, the pressure in the compression chamber 14 is gradually increased, and the highly pressurized refrigerant is discharged from the discharge port 15.

Naturally, the pressure of the highly pressurized refrigerant is exerted against the base plate 21 of the movable scroll member 20 from within the compression chamber 14. The highest pressure is exerted against the central portion of the base plate 21. As a result, as shown in FIG. 2, the center of the base plate 21 of the movable scroll member 20 receives a pressure in the direction shown by an arrow 40 in FIG. 2. Thus, the base plate 21 deforms or bends in response to the pressure as the central portion shifts towards the direction shown by the arrow 40. As shown in FIG. 3, the end portion 23 of the movable scroll member 20 is deformed from the resting position (as shown by the alternating long and two short dashed line 21*a*) to the position closer to the end face 13 of the stationary scroll member 10. That is, when the movable scroll member 20 receives high pressure, its center portion bends away from the stationary scroll member 10. However, because the portion around the outer peripheral portion 23 of the base plate 21 is restricted by the supporting member 24, the peripheral portion 23 projects toward the stationary scroll member 10 from the supporting member 24 as a base point. At this time, if the distance d2 that the peripheral portion 23 shifts is less than the distance d1, the peripheral portion 23 of the movable scroll member 20 does not contact the end face 13 of the stationary scroll member 10. Thus, the peripheral portion 23 of the movable scroll member 20 preferably has a shape that prevents contacts with the end face 13 of the stationary scroll member 10, even if the pressure in the compression chamber is increased. In this embodiment, the peripheral portion 23 may have a tapered shape, which provides a contact avoiding structure, and contact of the peripheral portion 23 of the movable scroll member 20 and the end face 13 of the stationary scroll member 10 can be avoided.

In the scroll compressor according to the first embodiment, when the movable scroll member 20 is deformed with respect to the stationary scroll member 10, no friction is generated between the peripheral portion 23 of the movable scroll member 20 and the end face 13 of the stationary scroll 10. As a result, power loss and seizing can be prevented or substantially reduced. This structure is advantageous over known structures for avoiding seizure, because the contact avoiding structure of the present teachings is easier to construct than, for example, increasing the thickness of the scroll wall of the movable scroll member 20 in order to make the scroll wall more rigid.

Second Representative Embodiment

A structure of a scroll compressor according to a second embodiment will be described with reference to FIG. 4. Elements that are the same as elements shown in FIG. 2 are identified by the same reference numerals. Because the scroll compressor according to the second representative embodiment is similar to the first representative embodiment, only the differences between the two embodiments will be described.

Figure 4:
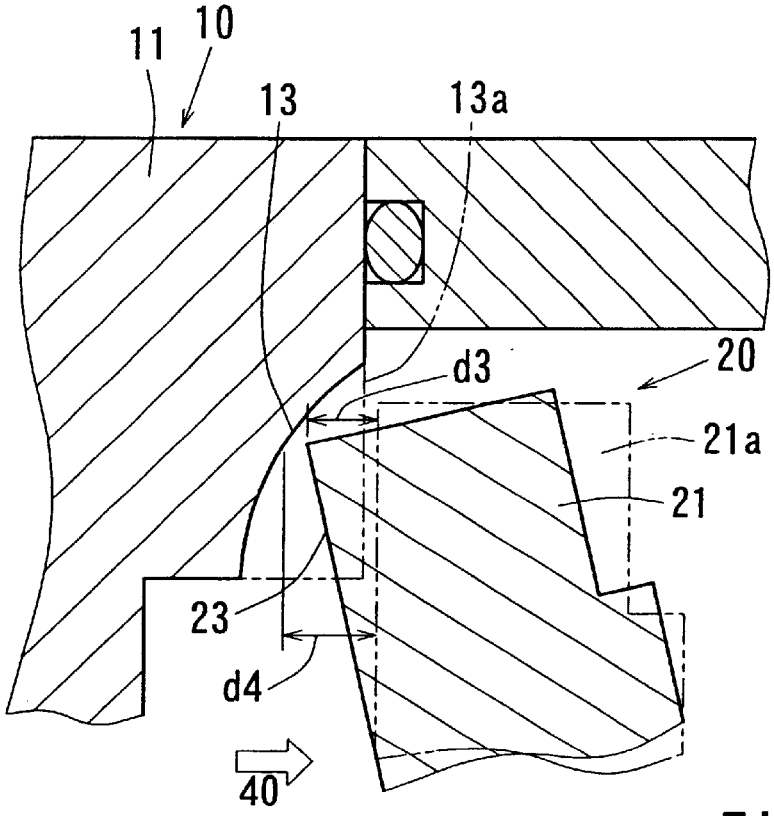
FIG. 4 is a partially enlarged view showing a periphery of an end portion of the movable scroll member according to a second representative embodiment, and illustrating the relative positions between the stationary scroll member and the movable scroll member.

As shown in FIG. 4, an outer peripheral portion 23 of a movable scroll member 20 opposes an end face 13 of a stationary scroll member 10. As shown by the alternating long and two short dashed line 21*a*, the end face of the peripheral portion 23 is substantially flat. On the other hand, the end face 13 of the stationary scroll member 10 has a recessed shape. That is, in this embodiment, the end face 13 of the stationary scroll member 10 has an arc-shaped depression (for example, at a distance d4 from the peripheral portion 23 of the movable scroll member 20). For comparison, the alternating long and two short dashed line 13*a* shows the shape used in known scroll compressors. Thus, the end face 13 of the stationary scroll member 10 of this embodiment also provides a contact avoiding structure of the present teachings.

Similar to the first representative embodiment, the high pressure refrigerant within the compression chamber 14 presses against the base plate 21 of the movable scroll member 20. As a result, the peripheral portion 23 of the movable scroll member 20 is shifted from the resting position, as shown by the alternating long and two short dashed line 21*a*, to the position closer to the end face 13 of the stationary scroll member 10. At this time, if the distance d3 that the end portion 23 shifts is less than the distance d4, the peripheral portion 23 of the movable scroll member 20 will not contact the end face 13 of the stationary scroll member 10. Thus, the end face 13 of the stationary scroll member 10 preferably has a shape that avoids contact with the peripheral portion 23 of the movable scroll member 20, even if the pressure in the compression chamber is increased. In this embodiment, the contact avoiding structure is a recess or depression, which generally prevents the end face 13 of the stationary scroll member 10 from contacting the peripheral portion 23 of the movable scroll member 20. Therefore, the scroll compressor of the second representative embodiment can also realize the advantageous effects noted with respect to the first representative embodiment.

Figure 5:
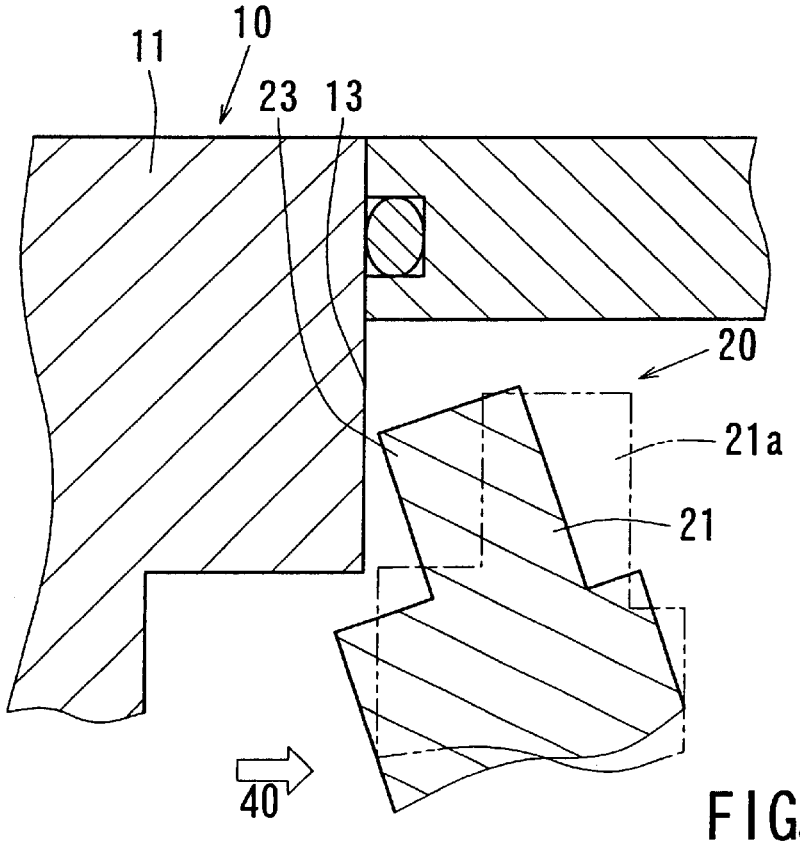
FIG. 5 is a partially enlarged view showing a movable base plate member that includes a step shape in its outer peripheral portion.
Figure 6:
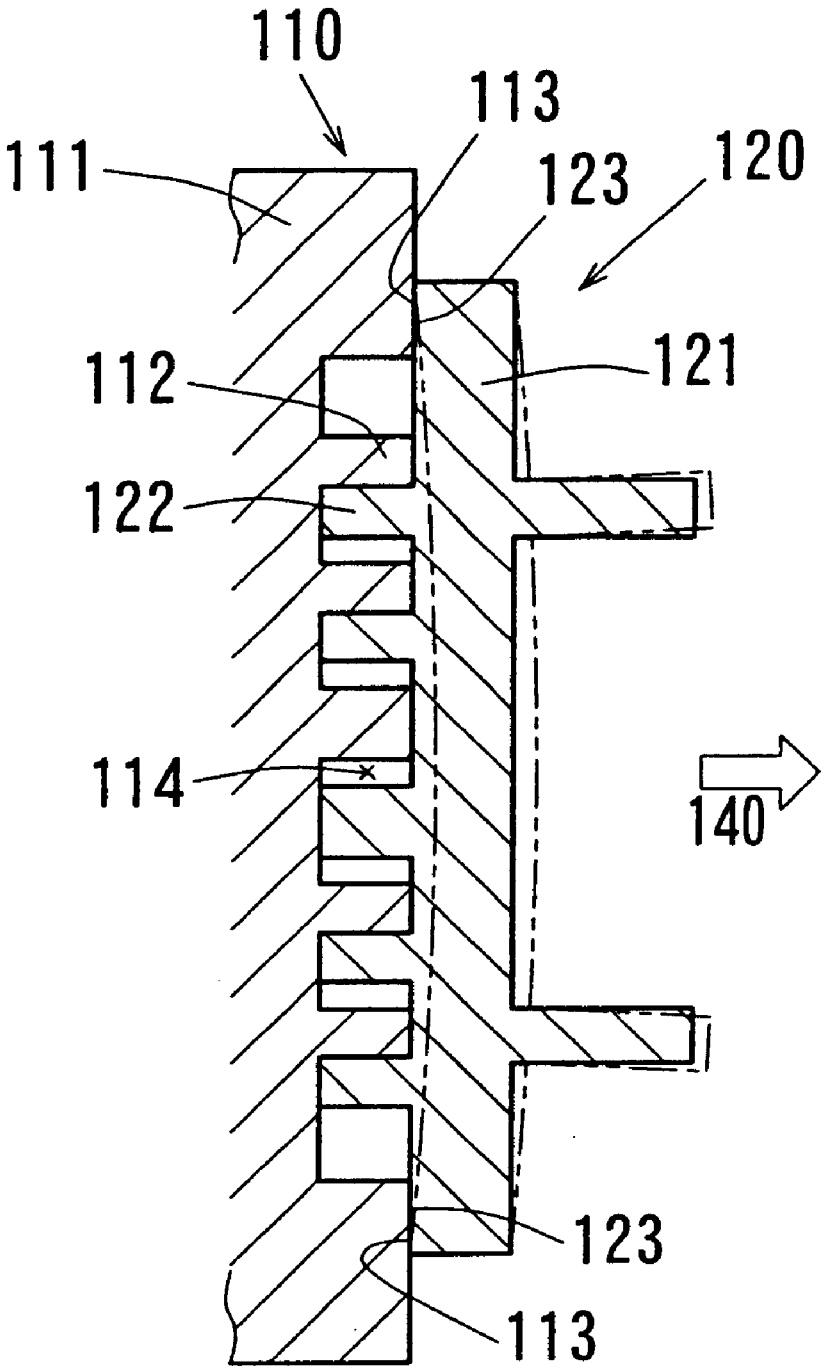
FIG. 6 PRIOR ART
FIG. 6 is a cross-sectional view schematically showing a known scroll compressor.

Naturally, the present teachings are not limited to the above-described embodiments and various applications and modifications thereof may be utilized. In particular, the shapes and positions of the contact avoiding structure are not limited to the above described embodiments and may be modified without departing from the spirit of the invention. For example, as shown in FIG. 5, the peripheral portion 23 of the movable scroll member 20 may be step shaped at the position that would normally contact the end face 13 of the stationary scroll member 10 when the movable scroll member 20 deforms. Moreover, both the shapes of the peripheral portion 23 of the movable scroll member 20 and the end face 13 of the stationary scroll member 10 may be altered from known shapes, in order to provide a contact avoiding structure. Further, although the preferred embodiments are utilized to compress a gas, the present teachings may naturally be utilized to construct compressors for other applications, such as liquids.

What is claimed is:

1. A scroll compressor comprising:

a stationary scroll member having a stationary base plate and a stationary volute wall extending from the stationary base plate, wherein the stationary base plate includes an end portion having an end face disposed at an outer periphery of the stationary base plate; and a movable scroll member having a movable base plate and a movable volute wall extending from the movable base plate, wherein the movable base plate includes an end portion having an end face disposed at an outer periphery of the movable base plate and the moveable base plate engages the stationary scroll member to define a compression chamber between the movable scroll member and the stationary scroll member, wherein fluid is pressurized in the compression chamber as the movable scroll member orbits with respect to the stationary scroll member, wherein at least one of the end portions of the stationary base plate and the movable base plate comprises a contact avoiding structure so that the end potion of the stationary base plate does not contact the end portion of the movable base plate when the compression chamber is under high pressure, wherein the contact avoiding structure is selected from the group consisting of (A) a tapered shape formed at the outer peripheral portion of the movable base plate, which tapered shape is inclined toward the outer peripheral direction, (B) a recess shape formed in the end face of the stationary base plate, and (C) a step formed in the outer peripheral portion of the movable base plate.

2. The scroll compressor according to claim 1, wherein the contact avoiding structure is the tapered shape formed at the outer peripheral portion of the movable base plate, which tapered shape is inclined toward the outer peripheral direction.

3. The scroll compressor according to claim 1, wherein the contact avoiding structure is the recess shape formed in the end face of the stationary base plate.

4. The scroll compressor according to claim 1, wherein the contact avoiding structure is the step shape formed in the outer peripheral portion of the movable base plate.

5. A scroll compressor according to claim 1, wherein the fluid is carbon dioxide.

6. An air conditioning system for a vehicle comprising at least a cooling circuit and a scroll compressor according to claim 1, the scroll compressor compressing fluid for operating the air conditioning system.

7. A method for compressing a fluid in the scroll compressor of claim 1, comprising:

drawing a fluid into the compression chamber, compressing the fluid and discharging a highly pressurized fluid, wherein the end portions of the scroll members do not contact when the fluid is pressurized and the movable scroll member deforms under pressure.

8. A method as in claim 7, wherein the contact avoiding structure is a tapered shape formed in the outer peripheral portion of the movable base plate and is inclined toward an outer peripheral direction.

9. A method as in claim 7, wherein the contact avoiding structure is a recess shape formed in the end face of the stationary base plate.

10. A method as in claim 7, wherein the contact avoiding structure is a step shape formed in the outer peripheral portion of the movable base plate.

11. The method as in claim 7, wherein the fluid is carbon dioxide.

12. A scroll compressor comprising:

a stationary scroll member having a stationary base plate and a stationary volute wall extending from the stationary base plate, wherein the stationary base plate includes an end portion having an end face disposed at an outer periphery of the stationary base plate; and a movable scroll member having a movable base plate and a movable volute wall extending from the movable base plate, wherein the movable base plate includes an end portion having an end face disposed at an outer periphery of the movable base plate and the moveable base plate engages the stationary scroll member to define a compression chamber between the movable scroll member and the stationary scroll member, wherein fluid is pressurized in the compression chamber as the movable scroll member orbits with respect to the stationary scroll member, wherein the end portions of the stationary scroll member and the movable scroll member are constructed and arranged to avoid contact when the movable scroll member deforms in response to a high pressure condition in the compression chamber, wherein the end portions of the stationary scroll member and the movable scroll member are selected from the group consisting of (A) a tapered shape formed in the outer peripheral portion of the movable base plate on the side facing the stationary scroll member, which tapered shape is inclined toward the outer peripheral direction, (B) a recess shape formed in the end portion of the stationary scroll member, and (C) a step shape formed in the end portion of the movable scroll member.

13. The scroll compressor according to claim 12 wherein the outer peripheral portion of the movable base plate at the side facing the stationary scroll member has the tapered shape, which tapered shape is inclined toward an outer peripheral direction.

14. The scroll compressor according to claim 12, wherein the end face of the stationary base plate has the recessed shape at a portion that would contact the outer peripheral portion of the movable base plate when the movable scroll member deforms under high pressure in the absence of the recessed shape.

15. The scroll compressor according to claim 12, wherein the outer peripheral potion of the movable base plate has the step shape at a portion that would contact the end face of the stationary base plate when the movable scroll member deforms under high pressure in the absence of the step shape.

16. A scroll compressor according to claim 12, wherein the fluid is carbon dioxide.

17. A scroll compressor comprising:

a stationary scroll member having a stationary base plate and a stationary volute wall extending from the stationary base plate, wherein the stationary base plate includes a first end face disposed at an outer periphery of the stationary base plate; and a movable scroll member having a movable base plate and a movable volute wall extending from the movable base plate, wherein the movable base plate includes a second end face disposed at an outer periphery of the movable base plate, wherein the first and second end faces extending substantially in parallel and directly oppose each other along an axial direction of the movable scroll member, which axial direction is substantially perpendicular to the orbital plane of the movable scroll member, and wherein the movable base plate engages the stationary scroll to define a compression chamber between the movable scroll member and the stationary scroll member, wherein fluid is pressurized in the compression chamber as the movable scroll member orbits with respect to the stationary scroll member, wherein at least one of the first and second end faces has a shape selected from the group consisting of a tapered shape, a recessed shape and a step shape, whereby the first end face does not contact the second end face when the movable scroll member deforms under high pressure.

18. The scroll compressor as in claim 17, wherein the first end face extends beyond the second end face.

19. A scroll compressor comprising:

a stationary scroll member having a stationary base plate and a stationary volute wall extending from the stationary base plate, wherein the stationary base plate includes a first end face disposed at an outer periphery of the stationary base plate; and a movable scroll member having a movable base plate and a movable volute wall extending from the movable base plate, wherein the movable base plate includes a second end face disposed at an outer periphery of the movable base plate, wherein the first and second end faces extending substantially in parallel and directly oppose each other along an axial direction of the movable scroll member, which axial direction is substantially perpendicular to the orbital plane of the movable scroll member, and wherein the movable base plate engages the stationary scroll to define a compression chamber between the movable scroll member and the stationary scroll member, wherein fluid is pressurized in the compression chamber as the movable scroll member orbits with respect to the stationary scroll member, wherein at least one the first and second end faces comprises means for preventing the first end face from contacting the second end face when the movable scroll member deforms under high pressure.

* * * * *